US009663340B2

(12) United States Patent
Garcia

(10) Patent No.: US 9,663,340 B2
(45) Date of Patent: May 30, 2017

(54) TOOL FOR HANDLING A SEWER COVER

(75) Inventor: Thomas Garcia, Saint-Hippolyte (KR)

(73) Assignee: EUROSIGN, Saint-Hippolyte (FR)

( * ) Notice: Subject to any disclaimer, the term of this patent is extended or adjusted under 35 U.S.C. 154(b) by 730 days.

(21) Appl. No.: 13/991,790

(22) PCT Filed: Dec. 6, 2011

(86) PCT No.: PCT/FR2011/052881

§ 371 (c)(1),
(2), (4) Date: Jun. 5, 2013

(87) PCT Pub. No.: WO2012/076806

PCT Pub. Date: Jun. 14, 2012

(65) Prior Publication Data

US 2013/0256616 A1 Oct. 3, 2013

(30) Foreign Application Priority Data

Dec. 6, 2010 (FR) ..... 10 60092

(51) Int. Cl.
*B66F 19/00* (2006.01)
*B66F 11/00* (2006.01)

(52) U.S. Cl.
CPC ..... *B66F 19/005* (2013.01); *B66F 11/00* (2013.01)

(58) Field of Classification Search
CPC ..... B66F 19/005; B66F 3/005; B66F 11/00
See application file for complete search history.

(56) References Cited

U.S. PATENT DOCUMENTS 2,086,318 A * 7/1937 Jackson ..... B66F 19/005 280/47.24
3,014,751 A * 12/1961 Smith ..... B23Q 3/1546 294/65.5
3,861,649 A * 1/1975 Mosley ..... B25B 27/02 254/124
4,365,925 A * 12/1982 Girtz ..... E01F 9/011 254/131

(Continued)

FOREIGN PATENT DOCUMENTS

DE 102005052905 A1 * 5/2007 ..... B66F 19/005
EP 0 484 285 A1 5/1992

(Continued)

*Primary Examiner* — Larry E Waggle, Jr.
*Assistant Examiner* — Tyrone V Hall, Jr.
(74) *Attorney, Agent, or Firm* — Andrew W. Chu; Craft Chu PLLC

(57) ABSTRACT

The tool for handling a cover, in particular covers for sewers or vents, or for manholes, relates to the covers of sewers or vents or manholes, having a substantially planar top surface. The tool includes a holder defining a surface for engaging with the top surface of a cover, a lifting fulcrum, and a handle. The handle has one end spaced apart from the lifting fulcrum. The holder, fulcrum and handle are arranged such that a force exerted by an operator on the one end is transmitted as a force on the holder by the lifting fulcrum. The holder includes a leg connected to the handle and is rigidly configured such that, in the position for lifting a cover, the assembly formed of the cover- and the holder with the leg is rigid. The invention further relates to a method for removing or re-placing such a cover.

15 Claims, 5 Drawing Sheets

(56) References Cited

U.S. PATENT DOCUMENTS

| | | | | | |
|---|---|---|---|---|---|
| 4,482,182 | A * | 11/1984 | Mortensen | B66F 19/005 | 254/131 |
| 4,488,706 | A * | 12/1984 | Kono | B66F 19/005 | 254/131 |
| 5,165,661 | A * | 11/1992 | Wright | B66F 19/005 | 254/131 |
| 6,520,482 | B1 * | 2/2003 | Bigham | B66F 19/005 | 254/131 |
| 7,503,743 | B1 * | 3/2009 | Friedrich | B66F 19/005 | 212/901 |
| 7,544,035 | B1 | 6/2009 | Friedrich | | |
| 2003/0062513 | A1 * | 4/2003 | Henderson | B66F 15/00 | 254/8 R |
| 2003/0146633 | A1 * | 8/2003 | Jung | B66C 1/04 | 294/65.5 |

FOREIGN PATENT DOCUMENTS

| | | | | |
|---|---|---|---|---|
| FR | 2528817 | A1 | 12/1983 | |
| FR | 2552259 | A1 * | 3/1985 | B28B 7/0017 |
| FR | 2702753 | A1 | 9/1994 | |

* cited by examiner 1
2
3
4
5
6
7
8
9
10
11
11a
12
13
14
14a
15
16
17
18
19
20
27

TOOL FOR HANDLING A SEWER COVER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention is related to the handling of covers, namely of sewer or road-manhole covers, or the like. It relates in particular to a tool for handling such covers, which can be referred to as a cover lifter, which should enable an operator to remove such a cover, in order to have access to the manhole or to the sewer, then to re-place it after the inspection.

The invention also relates to a method for removing and re-placing a sewer or road-manhole cover using the cover lifter according to the invention.

2. Description of Related Art Including Information Disclosed Under 37 CFR 1.97 and 37 CFR 1.98.

In the field of the tools for handling such covers, tools with hooks have since long been developed, which permit to take hold of the cover at a point of the cover in order to take hold of it with such hooks. Nevertheless, the covers are heavy, up to 70 kg, and their lifting is difficult, even if it is carried out by two persons. Furthermore, the covers are often jammed in their recess, by small stones or tar, which have been introduced into the gaps between the cover and its recess.

EPO 484 285 discloses a tool for handling covers including such a hook, a fulcrum, and a handle, thus permitting to gear down the force for separating the cover. Nevertheless, this tool provides no solution for an efficient removal of the cover, nor for its displacement to one side.

EP2 702 753 discloses a tool for handling covers, also with a hook, a fulcrum and a handle. The tool disclosed in this document permits in a first phase the separation of the cover from its recess (FIGS. 2 and 3), then the effective removal, with the displacement of the cover by means of two tools handled by two operators. Nevertheless, besides the necessity of causing two operators to intervene, the work remains difficult, since the whole weight of the cover has to be carried, then displaced and laid down.

U.S. Pat. No. 7,544,035 discloses a tool for handling covers with a hook and with a magnet. Two magnets are placed on the cover, then a bar with hooks is arranged so as to take hold of the two magnets, and the hook of the tool takes hold of the bar, in order to lift it. Nevertheless, if the magnets are not placed accurately on both sides of the center of gravity of the cover, it is highly likely that the latter tilts during the lifting.

There is thus a need for finding a solution permitting to facilitate the handling of such covers. With the tools of the state of the art, it could indeed be observed that about 20% of the operators have suffered from work accidents, namely with back troubles, or entrapment of fingers.

SUMMARY OF THE INVENTION

The present invention pretends to cope at least partially with the cited drawbacks and namely to make possible the removal and re-placing of a cover by one single operator, without requiring any accuracy in the positioning of the tool.

To this end, the invention relates to a tool for handling a cover including a substantially planar upper face, namely sewer or vent or road-manhole covers, including a means for holding a cover defining a plane aimed at cooperating with the upper face of said cover, a lifting fulcrum, and a handle provided with an end spaced apart from said lifting fulcrum, said holding means, fulcrum and handle being arranged so that a force exerted by an operator at the level of said end is transmitted as a force at the level of the holding means by means of said lifting fulcrum.

Said holding means is rigid in the vicinity of said plane, in order to impede any rotation of the cover about an axis included in said plane.

By impeding any rotation of the cover about an axis included in said plane, the tool permits, on itself, to lift the cover, while guaranteeing that the cover remains substantially horizontal. In this way is avoided the tilting of the cover, which could cause an impact on the tool, and which would in addition oblige to lift the cover much higher, in order to permit its displacement to a side of the opening in order to lay it down and to permit the access to the manhole or to the sewer. Since the cover remains horizontal, it is enough to lift it by some ten centimeters, then to displace it, and to lay it down next to the manhole.

Such rigid holding means in the vicinity of said plane can be a substantially vertical rod, and a substantially horizontal board rigidly fixed to said rod; the fastening of the cover to the board can occur by any means available for the specialist: glue, clamps, hooks, and yet other means.

According to further features:

said holding means includes a permanent magnet a box for protecting the magnet is arranged around the permanent magnet a separation fulcrum (28) and a separation means (21) are arranged in the immediate vicinity of said permanent magnet said tool includes a substantially rectilinear framework, said permanent magnet including a ridge in the vicinity of said plane, in which said separation fulcrum is formed of a ridge of said permanent magnet, and said separation means comprises a rod passing through said permanent magnet by one of its ends, and is arranged in abutment against said framework by the other one of its ends, so that, through a force applied by said framework on said rod, the latter protrudes with respect to said permanent magnet and, by pushing on said cover while forming a lever with said ridge, permits to separate the permanent magnet with respect to said cover said tool includes, at one of the ends of said framework, an extension extending away from said framework in order to serve as a lifting fulcrum on the ground, and including a tool leg hung from said movable framework rotating about the point of hanging from the framework, and extending away from the framework in the same plane and on the same side as said extension, said permanent magnet being rigidly fastened to its end away from the framework, said tool leg and said framework being arranged so that, in the position of the framework, in which the tool leg is placed on said cover and the extension is lifted up from the ground, said rod protrudes with respect to the permanent magnet and pushes on the cover, so that it moves the permanent magnet away from the cover the position of the tool leg is adjustable along said framework thanks to a plurality of drilled holes arranged along said framework, and in which a pin attaches said tool leg movably in rotation about said pin said leg and drilled holes are configured so as to permit blocking the cover raised in such a position that the force applied on the framework by the cover contributes through this position to reducing the load to be applied by the operator at the level of the handle said tool comprises a rear grip arranged on the framework, in front of the extension said extension is provided with at least one wheel, in order to facilitate the displacement of the tool loaded with the cover said extension is provided with two wheels, which can be spaced away from each other, so as to permit the tool to pass over a cover or an opening caused by the removal of a cover, both wheels passing on both sides of said cover or said opening said handle is arranged in a telescopic way, so as to permit to move the end of said handle away from said fulcrum a removable grip is arranged at the end of said handle, in order to facilitate the taking hold of said end by the operator, a receptacle being arranged in said protective box for receiving said grip when it is removed from said handle The invention also relates to a method for removing a cover, as well as to a method for re-placing a cover.

The advantage resulting from the present invention resides in that the removal and the re-placing are largely facilitated, and become possible with one single tool and one single operator.

Further features and advantages of the invention will become clear from the following detailed description, which refers to an exemplary embodiment given as an indication and in a non-restrictive way.

This description will be more easily understood when referring to the attached drawings.

DETAILED DESCRIPTION OF THE DRAWINGS

Figures 1, 2, 3:
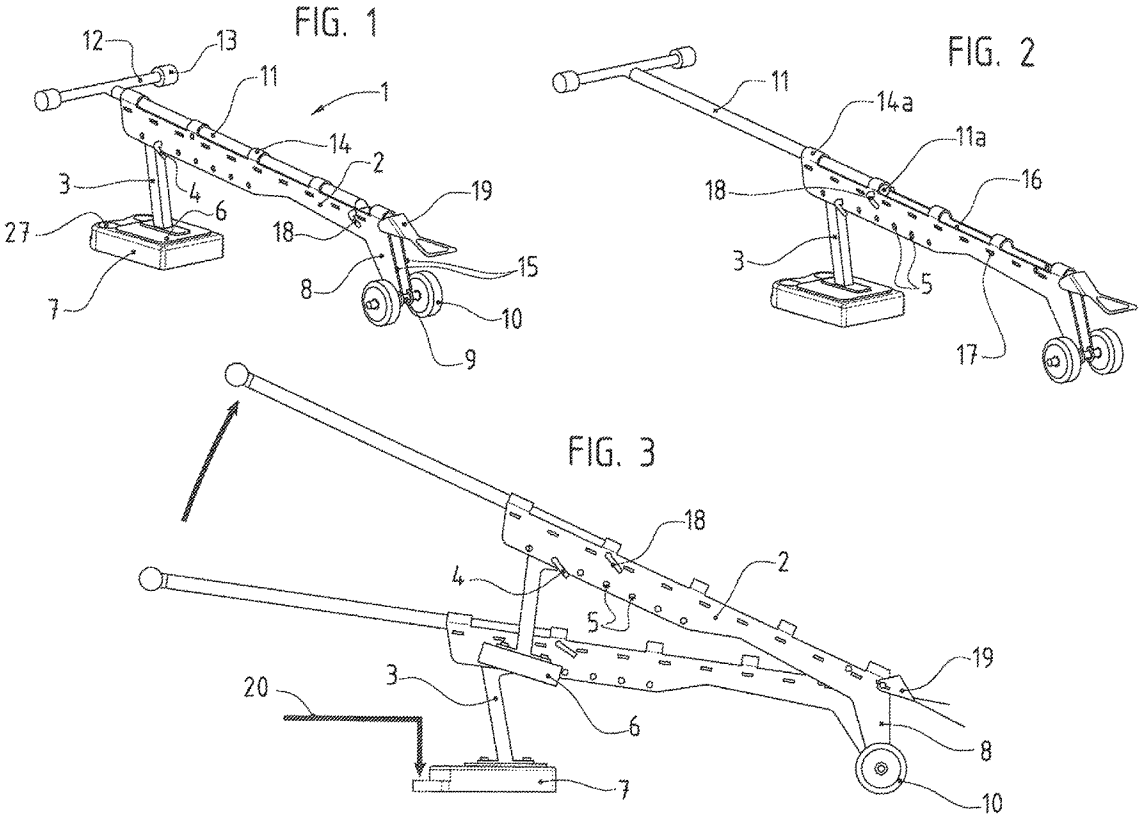
FIG. 1 represents a perspective view of a tool according to the invention in a resting situation.
FIG. 2 represents a perspective view of the tool of FIG. 1 in a second situation.
FIG. 3 represents a side view of the tool of FIG. 1 in the situation of FIG. 2 and in a third situation.
Figure 4:
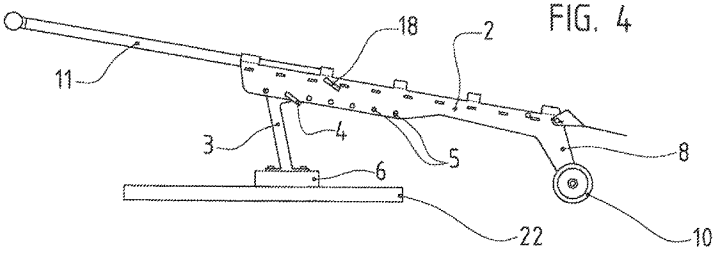
FIG. 4 represents a side view of the tool of FIG. 1 in a fourth situation.

As shown in FIGS. 1 to 6 and 8 of the attached drawing, the present invention relates to a tool 1, including a substantially rectilinear framework 2. A tool leg 3 is fixed to the framework 2 by means of a pin 4 passing through one of several drilled holes 5 provided for along the framework 2.

At the end of the tool leg 3 is arranged a permanent magnet 6 accommodated, in resting position, in a protective box 7. The latter serves, on the one hand, for protecting the permanent magnet 6 from scratches it might be subjected to during the displacements of the tool 1, on the other hand, for avoiding the permanent magnet 6 from being caught on metallic objects such as trucks or loading buckets that may be in the vicinity of the covers to be removed or re-placed. Furthermore, the protective box 7 avoids the magnet 6 from drawing small metallic objects that may be present on the road, such as nails, screws or clips.

At an end of the framework 2 is arranged an extension 8, at the end of which an axis 9 provided with two wheels 10 permits a fulcrum for the tool 1, easily movable in translation thanks to the wheels 10. The tool 1 may also be carried out without such wheels, the extension 8 resting directly on the ground, in order to form a fulcrum 8. In this case, the horizontal displacement shall occur either by causing the fulcrum 8 to slide or by causing the tool 1 to rotate about this fulcrum 8, in order to be able to place the cover 22 next to the manhole to be opened. With the wheels 10, both the translation and the rotation are largely facilitated. On a tool 1 according to the invention can be provided an extensible axis 9 that permits to move the two wheels 10 apart from each other, so that the two wheels 10 pass, one of them on one side, the other one on the other side of the cover 22. This way they do not roll on the cover 22 at all, which permits to pass over the opening even when the cover 22 is removed.

At the opposite end of the framework 2 with respect to the extension 8 is arranged a handle 11, at the end of which a traverse bar 12 and two grips 13 permit a good manual grip of the handle 11. The handle 11 may also be provided with only one grip 13 at the end 11*b* of the handle 11. This can be a round, square, polygonal, hollow or not, tube, or a tube of any other shape. According to an alternative, not shown, the handle 11 of the tool 1 may be reinforced, for example by inserting a bar having a rhombic cross-section into the hollow tube.

This handle 11 is fastened to the framework 2 in a telescopic way: it can slide along the framework 2 (see FIG. 2), maintained upwards by a plurality of hoops 14 connecting the two side plates 15 of the framework 2, and downwards by a sheet 16 arranged between the two side plates 15 of the framework 2, and provided with side keys that insert into slots 17 in the two side plates 15. This arrangement of the handle 11 permits to increase the total length of the tool 1. This permits to increase the lever arm at the location where the force for lifting the cover 22 is applied with the operator's hands, and thus to increase the force applied at the level of the cover 22.

When a lifting force is applied by the operator's hands at the level of the grips 13, this force results, at the level of the framework 2, into a torque, to which the framework 2 reacts by a resistance to an upward force at the level of the end hoop 14*a*, and a resistance to a downward force at the level of the end 11*a* of the handle 11 opposite the grips 13. In order to avoid said downward force at the level of the end 11*a* from prematurely damaging the sheet 16 at this location, a pin 18 is arranged in a drilled hole provided to this end at various positions along the framework 2, on which the end 11*a* of the handle 11 then rests. Said end 11*a* can also be provided with an appropriate shape that matches the shape of the pin 18 and partially surrounds it. Thus, this pin 18 accomplishes a second function, which is that of impeding the handle 11 from protruding fully out of the framework 2 in working position, or at least from going beyond the limit for which the forces received by the framework 2 and the handle 11 remain acceptable.

At the level of the extension 8, a rear grip 19 is arranged on the framework 2, the function of which will be specified below.

Figure 7:
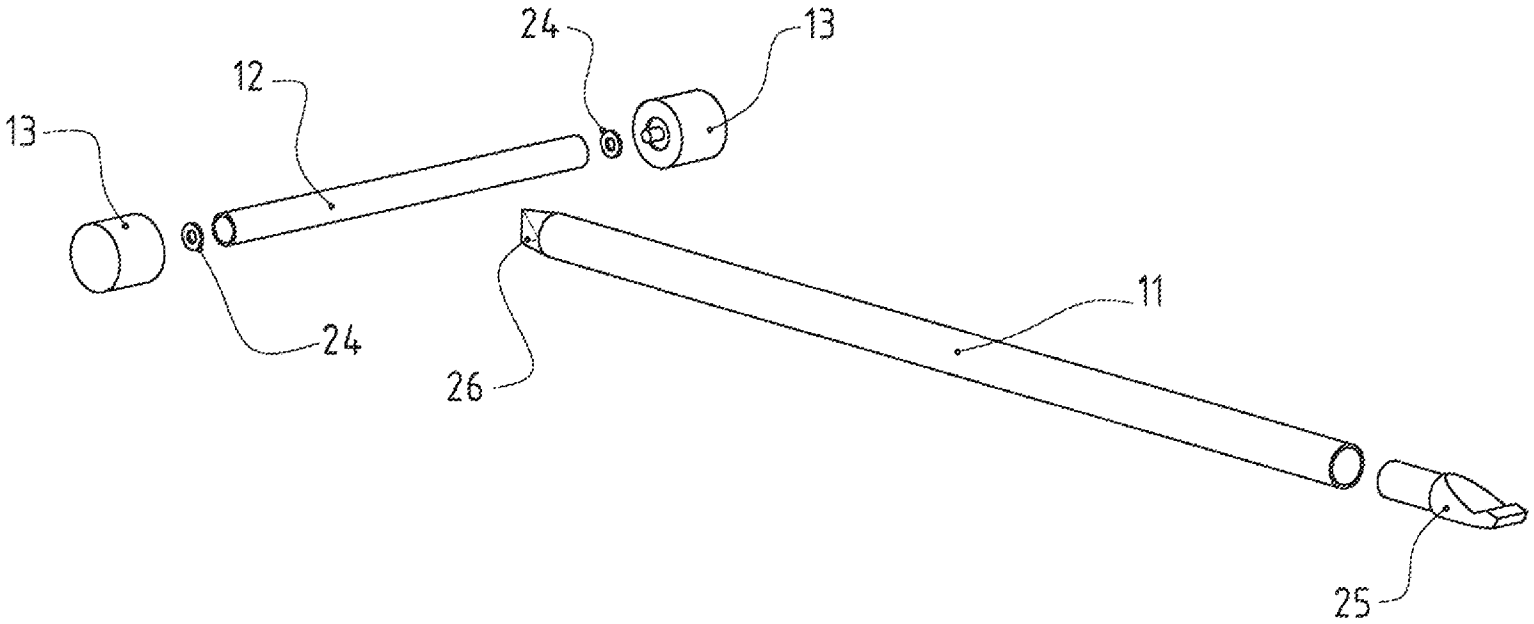
FIG. 7 represents an exploded view of an embodiment of an essential detail of the invention.

The operation of the tool 1 is then as follows:

The handle 11 is then first of all used alone, extracted from the framework 2 (see FIG. 7), in order to separate the cover 22, by using the handle 11 as a chisel for beating with the mass side 26, or as a miner's bar for locally lifting the cover 22 by means of the hook 25.

The handle 11 is then brought into a stretched position, the more stretched as a large lever arm is thought to be needed. The grips 13 can be mounted removably on the handle 11, in this case on the traverse bar 12, by means of a threaded rod arranged on the grips 13, which inserts into a tapped hole provided for in said traverse bar 12, washers 24 being inserted between said grips 13 and said traverse bar 12. When the grips 13 are not used, for example while the handle 11 is used alone, the grips 13 can be stored in two receptacles 27 provided to this end in the protective box 7 of the magnet 6.

The tool leg 3 is arranged on the framework 2 by means of a drilled hole 5 that is located the closer to the extension 8 forming a fulcrum 10 as the force to be applied seems more important. The closer this tool leg 3 is fixed to the fulcrum 10, the higher will be the force applied on the cover 22 for a given force applied at the level of the grips 13, but the shorter will be the lifting distance for a lifting distance conferred at the level of the grips 13. Thus, when a light, but thick cover 22 must be removed (for example a vent grid), it will be convenient to choose a position farther away from the fulcrum 10. While, when the cover 22 is heavier, a position closer to the fulcrum 10 should be chosen.

The magnet 6 is then extracted from its box 7 (see FIG. 3) by lifting the tool 1 by its grips 13, while placing its leg on a protrusion 20 arranged to this end on the box 7.

The tool 1 is then positioned above the cover 22 to be removed, and the magnet 6 is brought into contact with said cover 22 (see FIG. 4), preferably in a position close to the center of said cover 22.

This position close to the center needs not be reached accurately. It is indeed obvious that, when the magnet 6 is positioned at the edge of the cover 22, there will be an unbalance, and the cover 22 will be lifted only at the side where the magnet 6 will be positioned. On the other hand, it is enough to be positioned very approximately in the center of the cover 22 for the balance of the cover 22 to occur naturally.

Indeed, in the state-of-the-art solutions, when the cover 22 is hooked by means of a hook, it rotates freely about this hook, and the horizontal position of the cover 22 represents a very instable point of balance. By contrast, with a holding means 3 according to the invention, configured for impeding any rotation of the cover 22 about an axis included in a plane corresponding to the plane of the cover 22, the latter cannot tilt.

Figure 5:
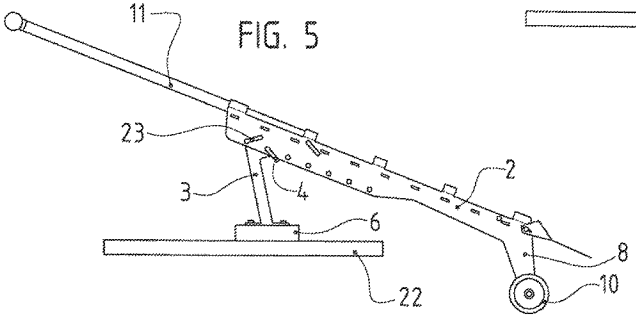
FIG. 5 represents a side view of the tool of FIG. 1 in a fifth situation.
Figure 6:
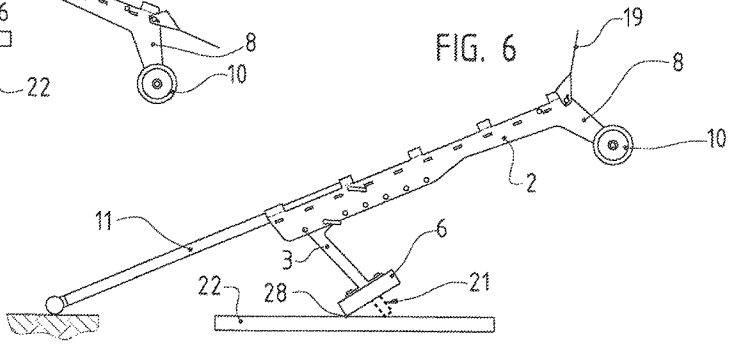
FIG. 6 represents a side view of the tool of FIG. 1 in a sixth situation.

This is shown in particular in FIG. 5 with a tool leg 3 provided with a permanent magnet 6, like in the exemplary embodiment of the figures. The assembly consisting of the cover 22, the magnet 6 and the tool leg 3 is rigid. This aggregate can rotate, but about the axis located at the level of the pint 4, which is located at several tens of centimeters above the cover 22. Thus, if the cover 22 were inclined to tilt, it would be about this axis. This would oblige its center of gravity to raise, which it would not do spontaneously. The balance of the cover 22 in horizontal position is thus stable.

When the magnet 6 is positioned somewhat away from the center of the cover 22, the balance will be found in a position in which the cover 22 is not perfectly horizontal, but it will still be a stable balance close to the horizontal position. A perfectly satisfactory operation of the tool has been observed with the magnet located at one third of the radius of the cover 22, with at least twice as much cover weight on one side of the magnet as on the other side.

The fastening of the tool leg 3 to the framework 2 could also be made rigid; this would provide the cover 22 with a forced position, which would also be close to the horizontal line.

The advantage of letting this fastening freely rotate about the point of hooking to the framework 2 is that, while preserving the advantage of a stable balance without accurate positioning, it avoids, on the one hand, inducing additional stresses on the framework 2, and thus increases its lifetime and, on the other hand, it avoids increasing the force the operator must maintain in order to hold the cover 22 in raised position.

The next step consists in displacing the cover 22, in order to place it next to the opening, in order to make it free and to be able to have access to it. In the embodiment shown, the wheels 10 largely facilitate this displacement.

The operator can then lower the tool 1 until the plate 22 rests on the ground.

The tool 1 can then be separated from the cover 22 according to the method explained below, or remain united with the cover 22 until the moment at which the cover 22 must be re-placed.

When the cover 22 must be re-placed, the operator lifts the cover 22, like during the removal, positions it above the opening, then lowers it until it is in place.

Now remains to separate the magnet 6 from the cover 22. Now, the force applied by the magnet 6 is high, in order to guarantee its capacity of lifting the cover 22, despite the frictions in the opening at the moment of the removal. This force is therefore considerably higher than the weight of the cover 22. The lever arm between the grips 13 and the lifting fulcrum 10, which is in the range of twice that between the force of the magnet 6 on the cover 22 and the lifting fulcrum 10 in the example shown, is then not sufficient to separate the magnet 6 from the cover 22.

A rod 21 has been inserted into the tool leg 3. This rod 21 extends downwards until through the magnet 6, and upwards until the sheet 16, when the tool 1 is in the position of FIG. 4. Since the point of hanging of the tool leg 3 from the framework 2 is sidewise shifted rearwards (towards the lifting fulcrum 10), in raised position (FIG. 5) the sheet 16 moves apart from the upper end of the rod 21, which does not produce any particular effect. In contrast, when the tool 1 is caused to tilt in the opposite direction, by lifting the side of the wheels 10, the sheet 16 pushes on the end of the rod 21, which then pushes with its other end on the cover 22. When continuing to lift the tool 1 with the side of its wheels 10, for example with the rear grip 19, a lever effect is created between a ridge 28 of the magnet 6 and the end of the rod 21. The lever effect is then much greater, since it is related to the ratio between the distance between the rear grip 19 and the tool leg 3 and the distance between the rod 21 and the ridge 28 of the magnet 6, which can provide, according to the exemplary embodiments, a ratio in the range from 1 to 10, compared to a range of for example 1 to 2 in normal operation of the tool 1. Such a lever ratio permits without any difficulty to separate the magnet 6 from the cover 22.

Then, when continuing the movement, the tool 1 rests on the ground with the end 11*b* of the handle 11 (see FIG. 6), and the tool leg 3 moves away from the cover 22, which ends the operation. Said rod 21 is arranged so as to pass through the magnet 6, in the example shown. It could however also be arranged immediately next to the magnet 6. What is important is that the distance between the end of this rod 21 resting on the cover 22 and the ridge 28 of the magnet 6 farthest away from the lifting fulcrum 10 is small compared to the distance between the magnet 6 and the lifting fulcrum 10, at least 3 times smaller, and preferably at least 5 times smaller. This is met for example when the rod 21 is arranged next to the magnet 6 on the side farthest away from the lifting fulcrum 10.

According to another embodiment, the tool leg 3 and the drilled holes 5 in the framework 2 for its fastening can be arranged so that, in <<normal>> raised position of the cover 22 (see FIG. 5), the neighboring drilled hole 5 farthest away from the lifting fulcrum 10 is <<hidden>> by the tool leg 3; but, when further lifting the tool 1, this drilled hole 5 gets free, and an additional pin 23 can be inserted into same, thus impeding the tool leg 3 from adopting again its initial position. Thus, when lowering the tool 1 into its <<normal>> raised position, the tool leg 3 will remain more inclined than its balance position, the cover 22 being slightly inclined upwards on the side of the lifting fulcrum 10. The cover 22 will then exert, through the tool leg 3 and the additional pin 23, a torque on the framework 2 that tends to cause the latter to rotate in the same direction as the forces applied on the grips 13 by the operator. Thus, the forced unbalance of the cover 22 will reduce the force to be applied by the operator, by transmitting the force onto the fulcrum, and namely onto the wheels 10. The displacement of the cover 22 is then made easier for the operator.

Figure 8:
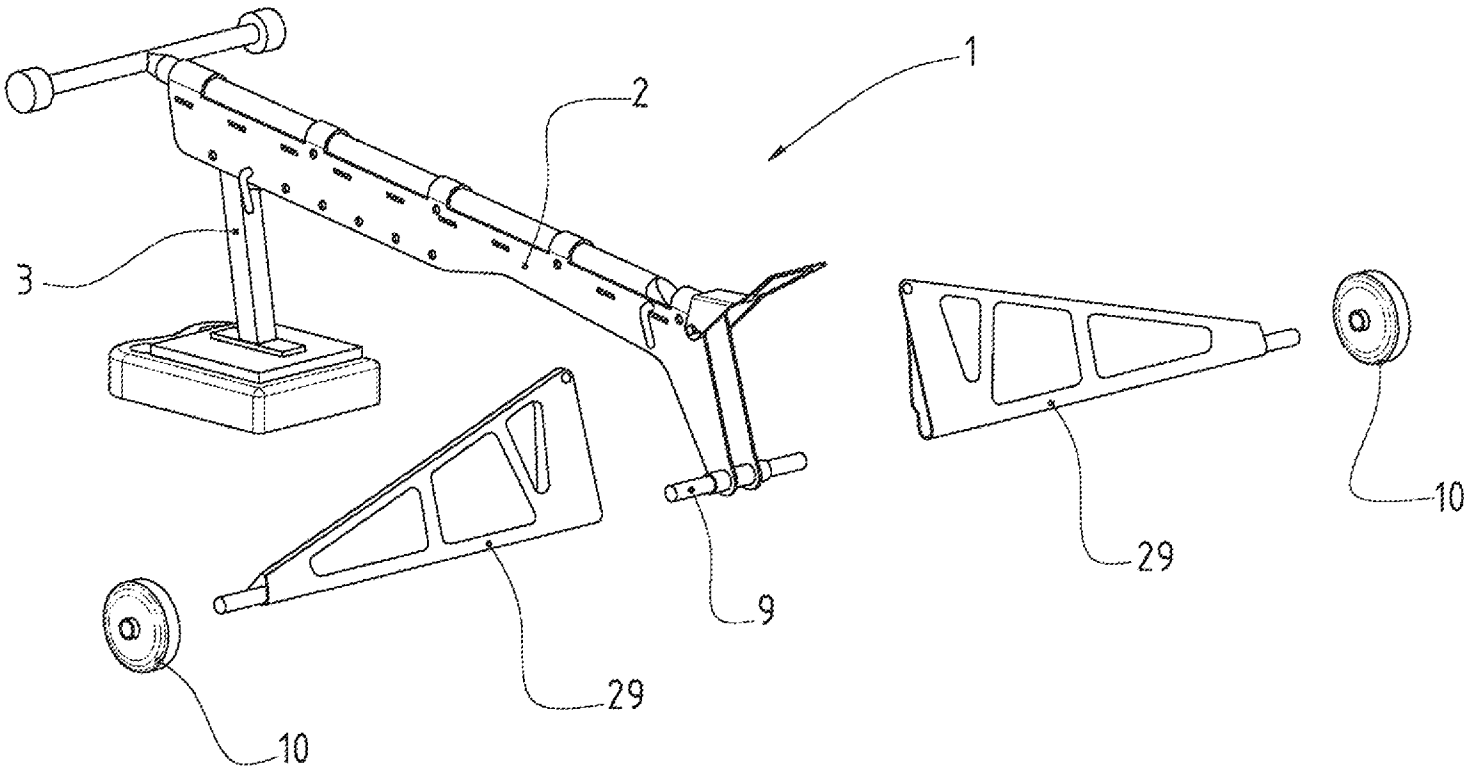
FIG. 8 represents a schematic and exploded view of a variant of the tool according to the invention.

When referring to FIG. 8, one can see that, according to a variant of the invention, it is possible to widen the track of the wheels 10, so that they pass on both sides of the large-size cover, this transformation being achieved through two extenders 29, each one intercalated between a wheel 10 and the framework 2.

Figure 9:
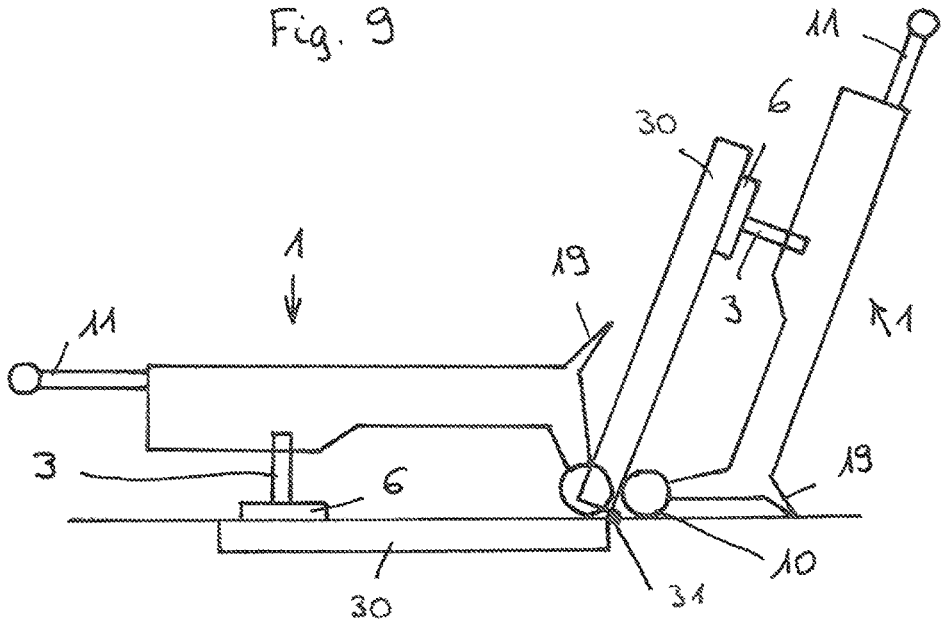
FIG. 9 represents a schematic view of the tool of FIG. 1 in closed and open situation of one embodiment of a hinged cover.

When referring to FIG. 9, the tool according to the invention can advantageously be used to open a so-called hinged cover 30. Such covers 30 are not aimed at being removed, but merely opened like a window, an end of the cover being mounted on a hinge 31.

To open such a cover, the tool is arranged above the cover 30, the magnet 6 being positioned in the area opposite the hinge 31; then the position of the leg 3 is adjusted so as to be able to position the wheels 10 close to the hinge 31, preferably placed on the cover 30. It is then enough to lift the handle 11, which opens the hinged cover 31. In this case, the handle is lifted up to the vertical line, until the tool 1 rests on the ground with its rear grip 19. In this position, the hinged cover 30 has performed a rotation of more than 90° about its hinge 31, and is stable in open position. The closing occurs by means of the reverse movement. Here too, the exact position of the magnet 6 on the area of the cover 30 far away from the hinge 30 does not matter. It will easily be understood that the farthest this position is away from the axis of the hinge 31, the lesser the tool 1 will be stressed, but the force to be applied will be similar. Furthermore, the closer the wheels are positioned to the hinge, the smaller will be the stresses induced into the tool, but here too the force to be applied by the operator will be similar.

Figure 10:
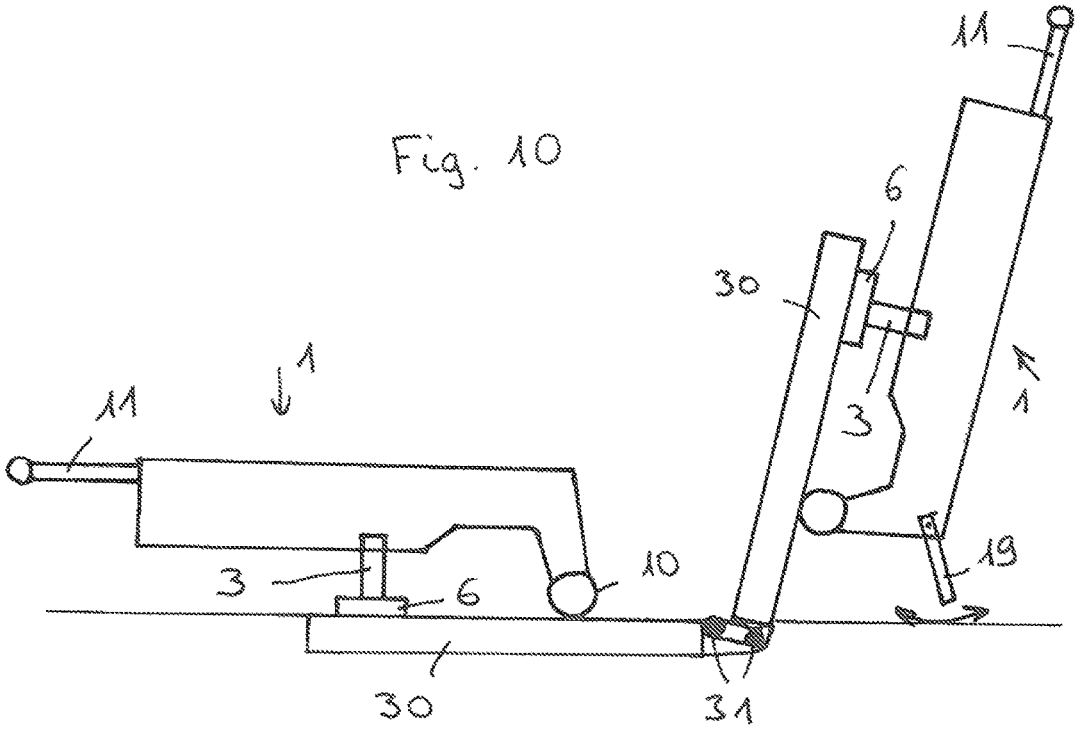
FIG. 10 represents a schematic view of the tool of FIG. 1 in a closed and open situation of another embodiment of a hinged cover.

According to an alternative shown in FIG. 10, the tool 1 according to the invention permits to open a hinged cover 30 the hinge of which 31 permits an open position stable on itself. The position of the wheels is then advanced towards the center of the cover, so that in open position the tool can easily be removed from the cover, by taking hold of it at the rear grip 19, as described above.

Said rear grip 19 can also be designed movable in rotation about an axis, as shown in FIG. 10, which permits a more pleasant esthetical appearance of the tool. For the application shown in FIG. 9, it is enough to provide a stop in rotation of the grip (not shown).

I claim:

1. A tool for handling a cover with a substantially planar upper face said tool comprising:

a framework having a handle at one end and a lifting fulcrum at an opposite end;

a holding means for an upper face of said cover, said holding means being comprised of a leg pivotally attached to said framework and a permanent magnet attached to said leg so as to removably engage said cover;

a separation fulcrum on said permanent magnet; and a separating means for said cover, being arranged in an immediate vicinity of said permanent magnet and pivoted relative to said separation fulcrum by said handle through said framework, wherein a force exerted on said handle is transmitted as a force on said holding means through said lifting fulcrum, and wherein another force exerted on said handle is transmitted as another force on said separating means through said separation fulcrum.

2. The tool, according to claim 1, further comprising:

a box engaged to said permanent magnet so as to protect said permanent magnet.

3. The tool, according to claim 2, further comprising: a removable grip arranged on said handle, wherein said box is comprised of a receptacle, said removable grip being contained in said receptacle for storage.

4. The tool, according to claim 1, wherein said separation fulcrum is comprised of a ridge on said permanent magnet, wherein said separating means comprises a rod having one end passing through said permanent magnet and another end arranged in abutment against said framework, and wherein said framework actuates said rod to protrude from said permanent magnet and rest on said cover, said rod with said ridge being a lever between said permanent magnet and said cover.

5. The tool, according to claim 4, wherein said opposite end of said framework has an extension connecting to said lifting fulcrum, wherein said leg extends downward from said framework, being pivoted at said framework in a same plane and on a same side as said extension, and wherein said extension pivots upward, wherein said leg and said framework protrude said rod from said permanent magnet and when said permanent magnet separates away from the cover.

6. The tool, according to claim 5, further comprising: a plurality of drilled holes arranged along said framework, a position of said leg corresponding to a drilled hole, and a pin pivotally attaching said leg to said framework.

7. The tool, according to claim 6, wherein said force exerted on said handle is reduced, when said leg and said drilled holes hold said cover in a raised position.

8. The tool, according to claim 5, further comprising:

a rear grip arranged on said framework at said extension opposite said lifting fulcrum.

9. The tool, according to claim 5, further comprising: at least one wheel mounted on said extension so as to facilitate displacement of the cover.

10. The tool, according to claim 5, further comprising: two wheels, each wheel being spaced apart from each other greater than a size of said cover so as to permit passing an opening caused by removal of said cover.

11. The tool, according to claim 1, wherein said handle is telescopic, so as to move said handle relative to said one end of said framework and said lifting fulcrum.

12. A method for removing a cover, said method comprising the following steps:

assembling said tool of claim 1;

lifting said leg by acting on said handle, wherein a box engages said permanent magnet;

placing said leg and said permanent magnet on said cover;

lifting the cover by acting on the handle; and displacing the tool with the cover.

13. The method, according to claim 12, further comprising the following steps:

positioning the cover in a recess; and lifting said framework, from said separating fulcrum in order to separate said permanent magnet from said cover so as to replace said cover.

14. A The method, according to claim 12, further comprising the following steps:

positioning said tool above said cover, said cover having a hinge, said holding means being placed on said cover in an area away from said hinge;

adjusting a position of the holding means so as to position the lifting fulcrum on said cover; and opening the cover by lifting said handle.

15. The method, according to claim 14, wherein said framework is comprised of a rear grip arranged on said framework at an extension at said opposite end and opposite said lifting fulcrum wherein the tool and the cover rest in an open position on said rear grip, said cover having a stable open position.

* * * * *